United States Patent [19]

Hurley

[11] Patent Number: 5,051,604

[45] Date of Patent: Sep. 24, 1991

[54] ELECTRICALLY NORMALLY CLOSED SWITCH DEVICE

[75] Inventor: Ricky A. Hurley, Fletcher, N.C.

[73] Assignee: Westinghouse Electric Corp., Pittsburgh, Pa.

[21] Appl. No.: 350,268

[22] Filed: May 11, 1989

[51] Int. Cl.[5] ..... H01H 47/00

[52] U.S. Cl. ..... 307/115; 307/132 E; 361/54; 361/189

[58] Field of Search ..... 361/54, 56, 57, 154, 361/189, 194; 307/112, 115, 132 E, 139, 140, 353, 639, 542.1; 200/144 AP

[56] References Cited

U.S. PATENT DOCUMENTS 4,476,355 10/1984 Mital ..... 200/5 A
4,523,251 6/1985 Erdmann et al. ..... 307/132 E X
4,692,834 9/1987 Iwahashi et al. ..... 361/91
4,720,763 1/1988 Bauer ..... 361/157

*Primary Examiner*—A. D. Pellinen
*Assistant Examiner*—Jeffrey A. Gaffin
*Attorney, Agent, or Firm*—M. J. Moran

[57] ABSTRACT

A mechanically normally open low voltage switch is connected between ground and the high impedance input of a low voltage electronic circuit fed by a low voltage source through a low impedance resistor. With the switch open, current flows into high impedance input of the electronic circuit to provide the electrically normally closed function. When the switch is actuated to the closed position, the high impedance input is pulled down to ground to provide the switch open function.

4 Claims, 2 Drawing Sheets

ELECTRICALLY NORMALLY CLOSED SWITCH DEVICE

BACKGROUND OF INVENTION

1. Field of Invention

This invention relates to electrical switches and more particularly it relates to an electrical apparatus which permits a normally open electrical switch to perform the function of a normally closed switch. It has particular application to the use of low voltage switches of the type referred to generally as membrane switches, which are all normally open, to perform the function of a normally closed switch in low voltage electronic circuits.

2. Background Information

A type of electrical switch which is widely used today in low voltage applications is the so called "membrane" switch. This is a general classification of mechanically simple electrical switches used with low voltage, such as 5 volt, electronic circuits. Such circuits are widely used today in logic and control circuits where the active elements are solid state devices such as transistors which operate at these low voltages.

Because of the low voltages at which the membrane switches operate, they do not require a great deal of insulation, and do not need much opening separation since the voltage and current drawn by the circuits controlled by them are not high enough for arcing to become a problem. In their simplest form, they can be two parallel conductors biased apart by a resilient member. Pressure applied to one conductor brings the two into contact to close the switch. In another form, one contact is an electrically conductive concave disc which is positioned over a second contact. Often the switch elements are covered by an insulating membrane which also environmentally isolates the switch. Such switches are widely used such as in keyboards for electronic components and in many other applications.

A drawback of these simple low voltage switches is that they are only available as normally open switches. They are push button switches which only remain closed as long as pressure is applied. There are some applications, however, where it would be desirable to use these simple low voltage so called membrane switches, but a normally closed switch is required. One such application is a contactor or starter for motors. Typically, these devices include a stop switch which is normally closed. Such a switch which is sometimes referred to as a run permit switch provides power to a start switch which is a normally open switch. With the stop switch closed, actuation of the start switch provides power to the controlled device. The start switch normally seals in an energizing circuit so that the switch can be released. When it is desired to deenergize the controlled device, the normally closed stop or run permit switch is pressed to open the energizing circuit and break the seal in so that when the switch is released, the controlled device remains deenergized.

There exists a need therefore for a normally open switch device which utilizes low cost, low voltage normally open membrane type switches.

There is a further need for such a device which is itself simple and economical and is reliable.

SUMMARY OF INVENTION

These and other needs are satisfied by the invention which is directed to an electrically normally closed switch device for controlling the flow of current from a low voltage power source to an input of a low voltage, high input impedance load which includes, an input impedance device, namely a resistor, connected between the low voltage power source and the input to the low voltage, high input impedance load. A mechanically normally open low voltage switch is connected between the input to the high input impedance load and ground. With the switch open, the device performs a normally closed switch function as current flows from the low voltage power source, through the input impedance device to the load. The input impedance device has an impedance which is very low relative to the input impedance of the load such that there is very little voltage drop across the input impedance and thus the voltage of the signal applied to the load is substantially that of the source. When the mechanically normally open switch is actuated to the closed position, the input to the load is pulled down to ground so that no current flows into the load. Thus, with the switch closed, the device performs an open switch function.

As applied to a contactor controlled by a low voltage control circuit, the device can be used as the run permit or stop switch for the contactor with another mechanically normally open switch used as a start switch.

BRIEF DESCRIPTION OF THE DRAWINGS

A full understanding of the invention can be gained from the following description of the preferred embodiment when read in conjunction with the accompanying drawings in which.

DESCRIPTION OF THE PREFERRED EMBODIMENT

Figure 1:
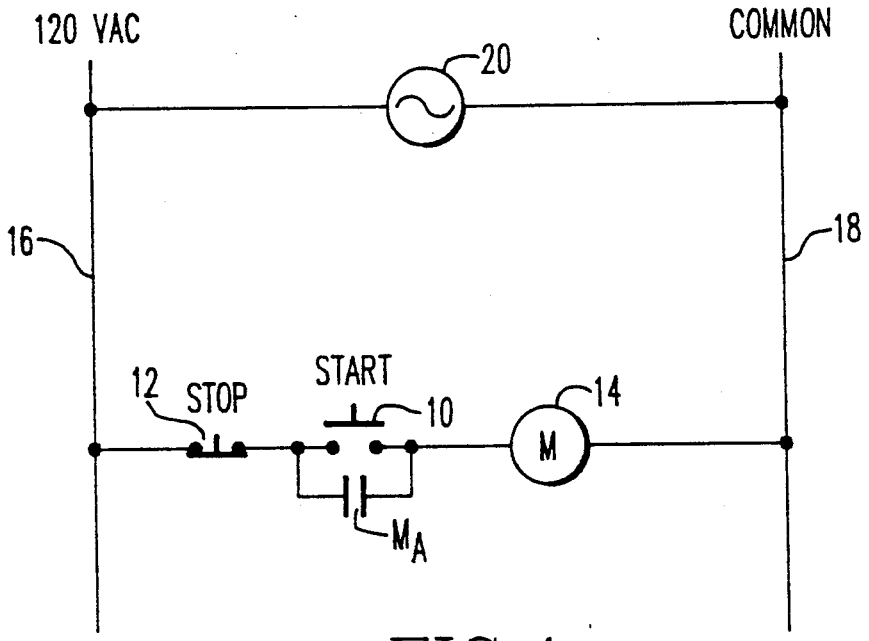
FIG. 1 PRIOR ART
FIG. 1 is a schematic diagram of a prior art switching arrangement for a motor.

FIG. 1 illustrates the typical prior art three wire START/STOP pushbutton arrangement such as would be used in controlling an electric motor. Such an arrangement includes a normally open START pushbutton 10, a normally closed STOP pushbutton 12 and the coil 14 of a motor control relay M connected in series across the conductors 16 and 18 energized by a 120 volt ac source 20. With the normally closed STOP switch 12 closed, actuation of the normally open START switch 10 to the closed position energizes the coil 14 of relay M. Pickup of the relay M closes normally open contacts $M_A$ to seal the relay in. Other contacts of relay M (not shown) actuate the contactor (also not shown) for the motor. When the STOP button is actuated, the relay drops out opening the contactor and the seal in contacts $M_A$ so that when the STOP button is released, the relay M and hence the contactor remain deenergized.

Figure 2:
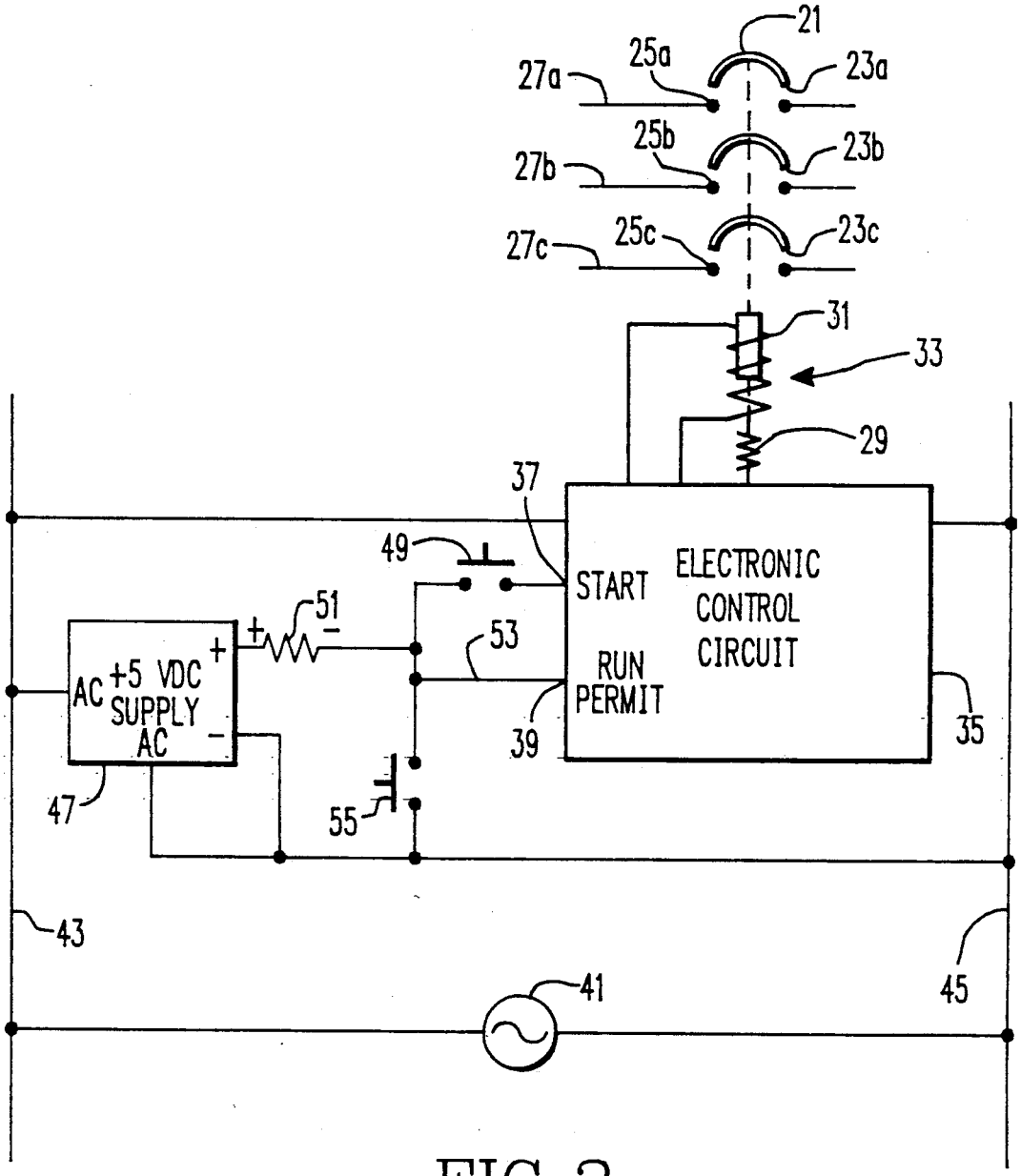
FIG. 2 is a schematic diagram of the electrically normally closed switch device of the invention as used in connection with an electrical contactor having a low voltage, high in impedance, control circuit.

Currently available contactors for motor control and other switching applications utilize low voltage, 5 volt, logic and control circuits. As shown in FIG. 2, such a contactor for a three phase motor (not shown) includes a contact bridge 21 carrying three sets of movable contacts 23*a*, 23*b* and 23*c* and three sets of fixed contacts 25*a*, 25*b* and 25*c* connected to the conductors 27a, 27b, and 27c supplying three phase current to the motor. The contact bridge 21 is biased to the open position by a kickout spring and a contact spring shown collectively as 29. Energization of the coil 31 of an electromagnet 33 closes the contacts 23–25. The coil 31 is energized by an electronic control circuit 35.

A contactor of this type is disclosed in U.S. Pat. No. 4,720,763. The electronic control circuit 35 of the contactor of this patent includes a START input 37 and a RUN PERMIT input 39. Both of these inputs have high impedances, on the order of 100,000 ohms. An ac source 41 provides 12O vac power on conductors 43 and 45 for energizing the electronic control circuit 35. A power supply within the electronic control circuit 35 converts the 120 vac into the supply voltages required. That power supply includes a +5 vdc supply 47 which is shown externally of the electronic control circuit 35 in FIG. 2 for clarity. Such power supplies are well known.

A low voltage, mechanically normally open switch 49 is connected to the first or START input 37 of the electronic control circuit 35. This switch is also connected through a low impedance input resistor 51 to the +5 volt terminal of the power supply 47. The second or RUN PERMIT input 39 of the electronic control circuit is connected by a lead 53 directly to the +5 volt supply through the input resistor 51. A second mechanically normally open switch 55 is connected between the second or RUN PERMIT input 39 and the common conductor 45.

The input resistor 51 has a value which is very low compared to the impedance of the inputs to the electronic control circuit 35. Ideally, the input resistor 51 should have value which is at least an order of magnitude less than the input impedance of the electronic control circuit 35. In the exemplary device, the input resistor 51 has a value of 1,000 ohms. With such a relative low value for the input resistor, there is substantially no voltage drop across the resistor with the switch 55 open so that substantially the full 5 volts of the power supply is applied to the electronic control circuit 35. However, the input resistor 51 must have an absolute value which limits the current drawn from the power supply 47 when the switch 55 is closed. In the exemplary system, this current is about 5 ma.

The START switch 49 functions conventionally as a normally open switch to provide a start signal through the input terminal 37 to the electronic control circuit 35 when actuated. With the circuit arrangement shown in FIG. 3, the normally open switch 55 functions as an electrically normally closed switch, such as switch 12 in FIG. 1 in its normally closed disposition. With the switch 55 in its normally open condition, current flows from the +5 vdc supply 47 through the input resistor 51 to the RUN PERMIT input terminal 39 of the electronic control circuit 35. However, when the mechanically normally open switch 55 is actuated, the input terminal 39 is pulled down to common so that no current flows into the input terminal 39. Instead, current through the input resistor 51 is shunted to common.

In operation, the electrically normally open switch 55 allows current to be provided to the electronic control circuit 35 through input terminal 39. When the START switch 49 is actuated, the electronic control circuit 35 energizes the coil 31 to close the contactor contact sets 23–25. The electronic control circuit 35 includes a microcomputer that maintains energization of the coil 31 when the START switch is released. Actuation of the RUN PERMIT switch 55, pulls the input 39 down to common to terminate energization of the coil 31 and the sets of contacts 23–25 open in the same manner as opening switch 12 of FIG. 1. Release of the switch 55 reapplies current to the RUN PERMIT input 39 of the electronic control circuit 35.

Figure 3:
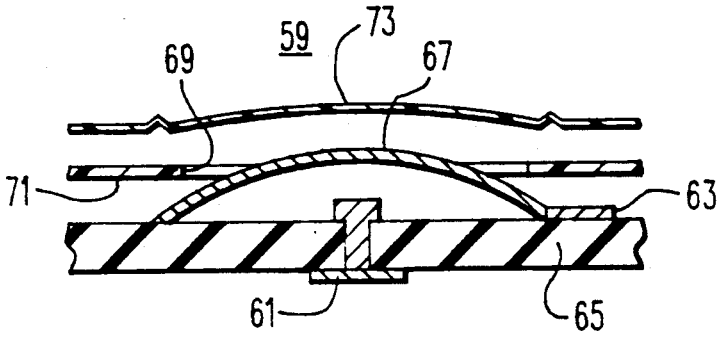
FIG. 3 PRIOR ART
FIG. 3 is a vertical sectional view through one type of a mechanically normally open membrane switch which can be used in the invention.

FIG. 3 illustrates an example of a commercially available low voltage switch 59 of the type commonly referred to as a "membrane" switch suitable for use as the switches 49 and 55. These switches 59 include two printed circuit conductors 61 and 63 on a substrate 65. An electrically conductive dome member 67 is connected to one of the conductors 63 and is normally spaced from the other conductor 61 due to its concavity. The conductor 61 passes through a plated through hole in the substrate and extends along the opposite face of the substrate 65. The center of the dome member 67 protrudes through an aperture 69 in a spacer 71 and is covered by an overlay 73 which may be embossed with a legend designating the function of the switch, such as START or RUN PERMIT. The overlay 73 also isolates the switch electrically and prevents dust, moisture et cetera from entering the switch. The switch 59 is actuated by pressing on the overlay 73 which deflects the center of the dome 67 down into contact with the conductor 61 to complete the electrical circuit between the conductors 61 and 63. The switch 59 is exemplary only and is not in itself part of the invention. Other types of low voltage switches could be used instead for the switches 49 and 55. It is also to be understood, that while the invention has been described as applied to an electrical contactor, it could also be used with other low voltage circuits where an electrically normally closed switch is needed.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed:

1. An electrically normally closed switch device for controlling the flow of current from a low voltage power source to an input of a low voltage high input impedance load, said device, comprising:

an input impedance connected in series between the low voltage power source and the input to said low voltage high impedance load; and a mechanically normally open low voltage switch connected between said input to said low voltage high input impedance load and ground, said mechanically normally open low voltage switch providing a normally closed switch function when mechanically open by permitting current to flow from said low voltage power source into the input to said low voltage high impedance load and providing an open switch function by pulling the input to said low voltage high input impedance load down to ground thereby terminating the flow of current into said low voltage high input impedance load when mechanically closed.

2. The device of claim 1 wherein said input impedance has an impedance which is small compared to the input impedance of the high input impedance load, such that substantially the full voltage of the low voltage power source is applied to the input of said low voltage high input impedance load.

3. An electrical contactor system, comprising an electrical contactor including normally open electrical contacts, electromagnet means which when electrically energized closes said normally open electrical contacts, and a control circuit with first and second inputs selectively energizing said electromagnet means in response to a start signal applied to the first input and maintaining energization of said electromagnet means for the duration of a run permit signal applied to the second input, said control circuit having a high input impedance at both inputs;

a low voltage power source;

an input impedance device having a low input impedance relative to the high input impedance of said control circuit connected between said low voltage power source and said second input to said control circuit;

a first mechanically normally open low voltage switch connected to the first input to the control circuit and energized by said low voltage power source providing said start signal when actuated; and a second mechanically normally open low voltage switch connected between said second input of said control circuit and ground, said mechanically normally open second low voltage switch providing a normally closed switch function when mechanically open by permitting current to flow from said low voltage power source through said input impedance device into said second input to said control circuit, and providing an open switch function by pulling said second input to the control circuit down to ground thereby terminating the flow of current to said second input of the control circuit when mechanically actuated.

4. The electrical contactor system of claim 1 wherein said first mechanically normally open switch is connected in series with said input impedance device between said low voltage power source and the first input to said control circuit.

* * * * *